US005215475A

United States Patent [19]

Stevens

[11] Patent Number: 5,215,475

[45] Date of Patent: Jun. 1, 1993

[54] DEVICES FOR USE WITH HIGH VOLTAGE SYSTEM COMPONENTS FOR THE SAFE EXPULSION OF CONDUCTIVE MOISTURE WITHIN SUCH COMPONENTS

[75] Inventor: David R. Stevens, Andover, N.J.

[73] Assignee: Amerace Corporation, Hackettstown, N.J.

[21] Appl. No.: 907,867

[22] Filed: Jul. 2, 1992

[51] Int. Cl.[5] ..... H01R 4/60

[52] U.S. Cl. ..... 439/206; 439/88; 439/190; 439/921

[58] Field of Search ..... 439/88, 89, 181, 186, 439/205, 206, 921, 184, 185, 190

[56] References Cited

U.S. PATENT DOCUMENTS

| | | | |
|---|---|---|---|
| 3,980,374 | 9/1976 | Fallat | 439/921 |
| 4,059,329 | 11/1977 | Macemon | 439/921 |
| 4,766,011 | 8/1988 | Vincent et al. | 427/117 |
| 4,888,886 | 12/1989 | Eager, Jr. et al. | 34/104 |
| 4,946,393 | 8/1990 | Borgstrom et al. | 439/88 |
| 4,955,823 | 9/1990 | Luzzi | 439/921 |
| 5,082,449 | 1/1992 | Bergstrom et al. | 439/88 |
| 5,088,001 | 2/1992 | Yawovski et al. | 361/127 |
| 5,114,357 | 5/1992 | Luzzi | 439/921 |

*Primary Examiner*—Gary F. Paumen
*Assistant Examiner*—Hien D. Vu
*Attorney, Agent, or Firm*—Lerner, David, Littenberg, Krumholz & Mentlik

[57] ABSTRACT

Devices for use with high voltage system components for the safe expulsion of conductive moisture within such components include elbow and T-shaped connector bodies composed of insulating elastomeric bodies covered with conductive elastomer layers. The horizontal legs include all components normally found in such components. The bore of the vertical leg provides a circuitous passage from the horizontal leg to a container or the soil for the collection of such moisture. The circuitous path prevents the moisture from leaving as a stream and the grounded metal cap at the vertical leg extremity discharges any charge carried by the moisture. The circuitous path can be provided by modules each having a curved, linear or combined path such that the total path is longer than the length of the vertical leg. A vacuum access port can provide a means to draw out the moisture if gravity is insufficient to withdraw the moisture from the high voltage system components.

20 Claims, 5 Drawing Sheets

DEVICES FOR USE WITH HIGH VOLTAGE SYSTEM COMPONENTS FOR THE SAFE EXPULSION OF CONDUCTIVE MOISTURE WITHIN SUCH COMPONENTS

BACKGROUND OF THE INVENTION

1. Field of the Invention

The invention relates to an electrical apparatus for the removal of conductive moisture from the components of a high voltage system without requiring the de-energization of the overall system and more particularly to devices which can be attached to high voltage system components without disrupting the system for the removal of conductive moisture and which does so by disrupting the flow of streams of such moisture and grounding the charge carried by said moisture before expulsion of said moisture from said devices.

2. Description of the Prior Art

At present, when it is desired to expel conductive moisture, gases, contaminants or combinations of such materials, a device as shown in U.S. Pat. No. 4,946,393 issued Aug. 7, 1990 entitled "SEPARABLE CONNECTOR ACCESS PORT AND FITTINGS" by Alan D. Borgstrom and David R. Stevens and assigned to the assignee of the instant invention was employed. One such device was placed at each end of, for example, a cable run, to remove moisture collected therein. To one such device access port was connected a source of liquid or gas to be used to purge the moisture collected in the cable run. The other device was left with its access open so that the liquid or gases from the cable run could be expelled. Depending upon the pressure applied to the liquid or gas and the resistance to flow within the cable run, the expelled liquid, gas or moisture might take the form of a continuous stream and since the high voltage system was activated while this action took place, the liquid, gas or moisture expelled could be a conductive stream which could injure adjacent personnel or equipment.

U.S. Pat. No. 5,082,449 issued Jan. 21, 1992 entitled Removable Media Injection Fitting: by Alan D. Borgstrom Glen J. Bertini and Daniel F. Meyer and assigned jointly to the assignee of the instant invention and Dow Corning Corporation describes a device similar to that of the '393 patent and claims the devices for injecting fluids or gases into, for example, a cable run.

SUMMARY OF THE INVENTION

The present invention overcomes the difficulties noted above with respect to the prior art by providing a safe way to remove the contaminated liquid water, gases, and conductive moisture from a high voltage system component without causing a flashover while retaining the safety of a deadfront device. This is done by providing a device which can be plugged into existing high voltage system interfaces and which provides a long exit path such that the continuous flow of water within the system is interrupted and which discharges any charge carried by the liquid, gases or moisture exiting the system. A standard shaped component such as an elbow is fitted with a receptacle and probe in its horizontal leg so that it can be plugged into existing interfaces. The vertical leg is provided with components to establish a circuitous path which is longer than the exterior length of the vertical leg and which breaks up the continuous stream of exiting liquid into droplets or discontinuous smaller pools and discharges any accumulated charge of the liquid or moisture before it is permitted to exit the device and this is all carried out within a deadfront protected enclosure so that no person or equipment can come in contact with charged, current carrying moisture or liquid streams. It is an object of the invention to provide a device for the safe expulsion of conductive moisture from within the components of a high voltage system.

It is another object of the invention to provide a deadfront device for the safe expulsion of conductive moisture from within the components of a high voltage system.

It is another object of the invention to provide a deadfront device for the safe expulsion of conductive moisture from within the components of a high voltage system employing a long circuitous exit path which breaks up the continuous streams of liquid exiting from such device.

It is yet another object of the invention to provide a deadfront device for the safe expulsion of conductive moisture from within the components of a high voltage system employing a long circuitous exit path which breaks up the continuous streams of liquid exiting from such device and which discharges any charge or currents carried by the moisture or liquid before it exits the device.

Other objects and features of the invention will be pointed out in the following description and claims and illustrated in the accompanying drawings which disclose by way of example, the principles of the invention and the best mode which has been presently contemplated for carrying it out.

BRIEF DESCRIPTION OF THE DRAWINGS

In the drawings in which similar elements are given similar reference characters.

DESCRIPTION OF THE PREFERRED EMBODIMENTS

As is well known, stranded conductor, high voltage, shielded power cable commonly used by electric utilities to distribute electrical energy is adversely affected by the presence of water in the conductor strand interstices. Water enters the cable from potentially many sources, such as from unsealed ends during storage and installation, during the manufacturing process, from faults which expose the cable to ground water, and from the transmission of water vapor through the cable shields and insulation. The water, once inside the cable, shortens the cable's life by encouraging "tree growth" in the insulation, corrodes the conductor, often giving off detrimental by-products and reducing the effective strand area, thus reducing cable ampacity as well as generating steam when the temperature of the cable conductor reaches 100° C. Removal of the water from the cable can be accomplished by way of displacement with a dry gas, such as Nitrogen or special fluids can be used to repair damaged cable insulation. One of the fluids for restoring stranded conductor, polyolefin insulated electrical power distribution cable is described in U.S. Pat. No. 4,766,011 issued Aug. 23, 1988 entitled "Restoring Stranded Conductor Electrical Distribution Cable" by Gary A. Vincent and Daniel F. Meyer and assigned to Dow Corning Corporation. The dry gases or fluids are introduced by means of a fitting as shown in FIG. 1 of this Application and the moisture, gas/-moisture mixture or liquids are expelled through a similar fitting.

Figure 1:
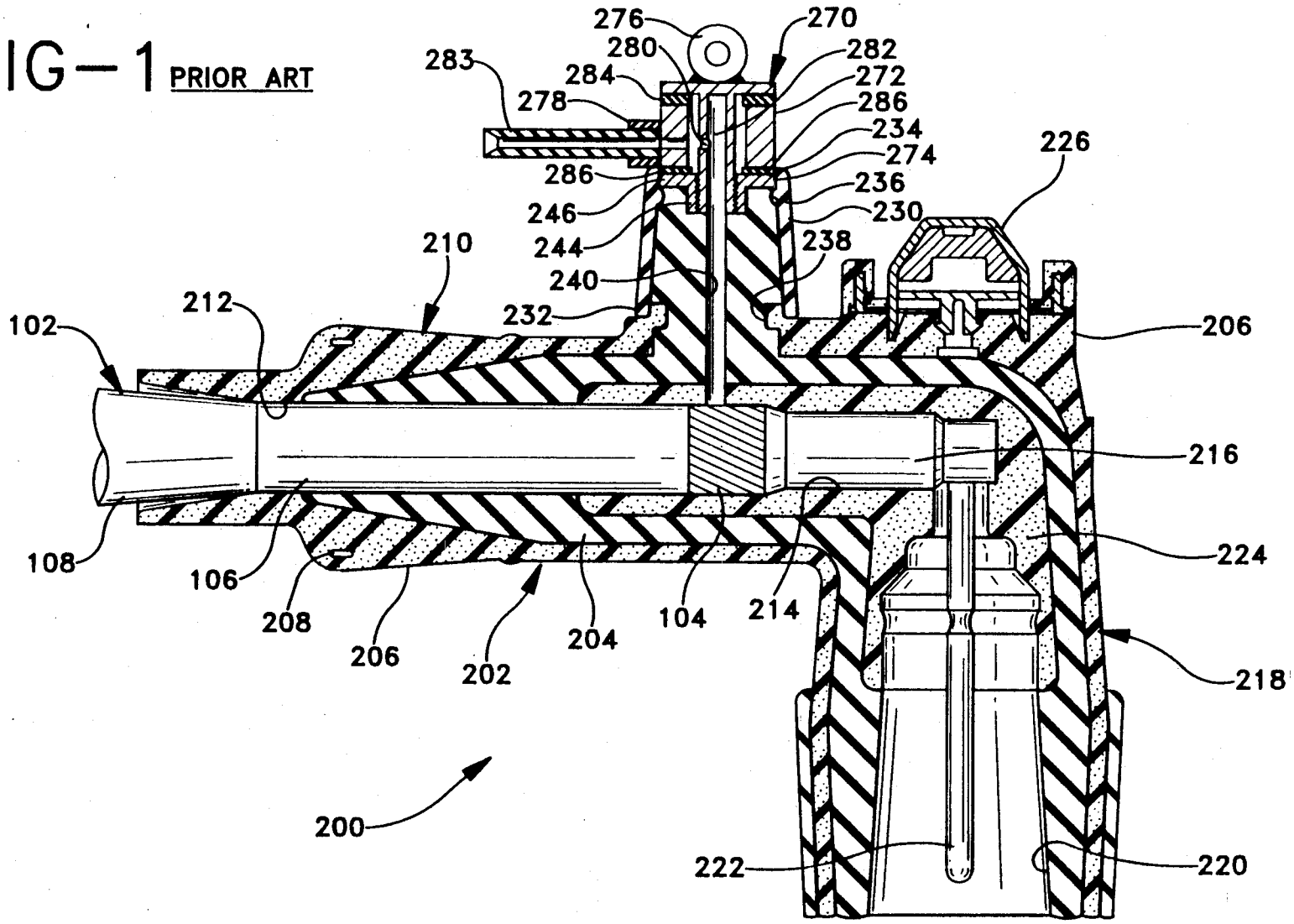
FIG—1 PRIOR ART
FIG 1 is a side elevational view, in section, of a high voltage separable connector component--namely an elbow having an access constructed in accordance with the invention of U.S. Pat. No. 4,946,393 and is FIG. 5 of such patent and showing a fitting for introducing liquids or gases into the components to which such elbow is connected.

Turning now to FIG. 1, there is shown a high voltage separable connector component or elbow 200 having a body portion 202 molded of an insulating elastomeric 204. Molded to insulating elastomeric 204 with a void-free interface is an external shield 206 of conductive elastomeric. Ports 208 are provided in shield 206 to attach suitable ground conductors. Horizontal leg 218 has central receptacle 220 to receive a bushing insert (not shown) as is well known in the art. A male probe 222 extends from a crimp connector 216 and through the receptacle 220. These elements and their manner of interconnection with other components of a high voltage system are fully set forth in American National Standard Institution ANSI standards 386 which by this reference is incorporated herein.

Vertical leg 210 has central bores 212 and 214 of a diameter sufficient to accept the insulation 106 and shield 108 of cable 102 when properly dilated. The bore 212 can also be used to accept other components such as surge arrester metal oxide varistor blocks of suitable dimensions as is shown for example, in U.S. Pat. No. 5,088,001 issued Feb. 11, 1992 and owned by the assignee of the instant invention.

The shield 206 is interrupted on leg 210 and the insulating elastomeric 204 of body portion 202 is extended outwardly, away from bores 212 and 214 to form projection 230 having a generally frusto-conical cross-section with its wide diameter base 232 adjacent shield 206 of body portion 202 and its smaller diameter free face 234 remote therefrom. A central bore 240 extends through projection 230 from free face 234 through the conductive elastomeric shield 224 into central bore 212 of leg 210.

With insulating cap removed, a swivel type hydraulic fitting 270 is inserted into and fastened to the projection 230 to introduce dry gases, fluids or the like to purge moisture, liquids, gases and contaminants from the system to which the elbow 200 is attached as is described in said '393 patent.

Because the stream of current carrying liquid is expelled directly from the fitting 270 outside of the deadfront elbow 200, it is possible to injure persons or equipment in the vicinity of exit elbow 200 who come in contact with such stream. It is therefore desirable to break up this stream into separated pools or droplets and to discharge any current or charges carried by the liquid or gases or moisture expelled within the safety of a deadfront component and before any possible contact with persons or equipment.

Figure 2:
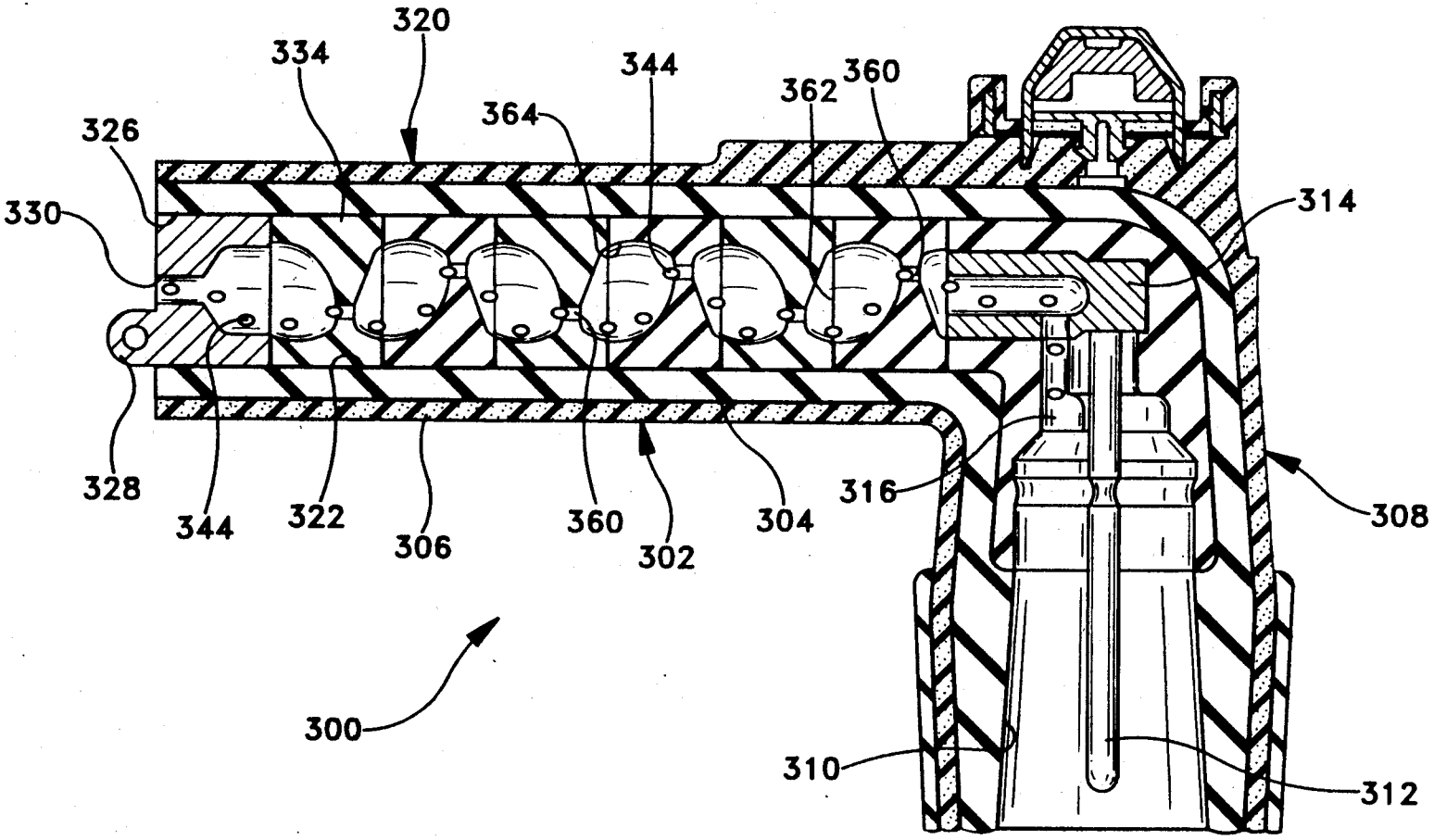
FIG. 2 is a side elevational view, in section, of a device constructed in accordance with the concepts of the invention.

This can be accomplished by the device of FIG. 2 to which reference is now made. A high voltage separable connector or elbow 300 having a body portion 302 molded of an insulating elastomeric 304 such as insulating ethylene propylene diene-monomer rubber commonly identified as EPDM rubber and covered with a shield layer 306 of conductive elastomeric, such as EPDM rubber with conductive carbon black added, is molded with a void-free interface between layers 304 and 306. A horizontal leg 308 contains a receptacle 310 and a male probe 312 for connection to suitable bushings or bushing inserts, the shape and dimensions of which are described in the aforesaid ANSI 386 standard. Male probe 312 terminates in a hollow metal fitting 314 which also contains a passage 316 to permit any fluid or gases introduced via receptacle 310 to enter fitting 314.

Vertical leg 320 contains a central bore 322 into which are introduced a number of modules 324 molded of non-tracking insulating material such as EPDM rubber, silicone rubber, ceramic or similar materials. The diameter of bore 322 is slightly less than the outside diameter of modules 324 so that body portion 302 is slightly dilated increasing the diameter of bore 322 when the modules 324 are inserted into bore 322 securely grip the outer surfaces of modules 324 adjacent body portion 302. A metal cap 326 is similarly proportioned and is held in place by the body portion 302. To improve the hold of the body portion 302 on the cap 326, suitable adhesive may be applied to the outer surface of the cap 326 or the inside surface of body portion 302. A non-conductive band could also be used on the outer surface of body portion 302 to compress it into intimate contact with cap 326. The modules 324 may also be affixed to body portion 302 by the use of suitable adhesives.

Figure 5:
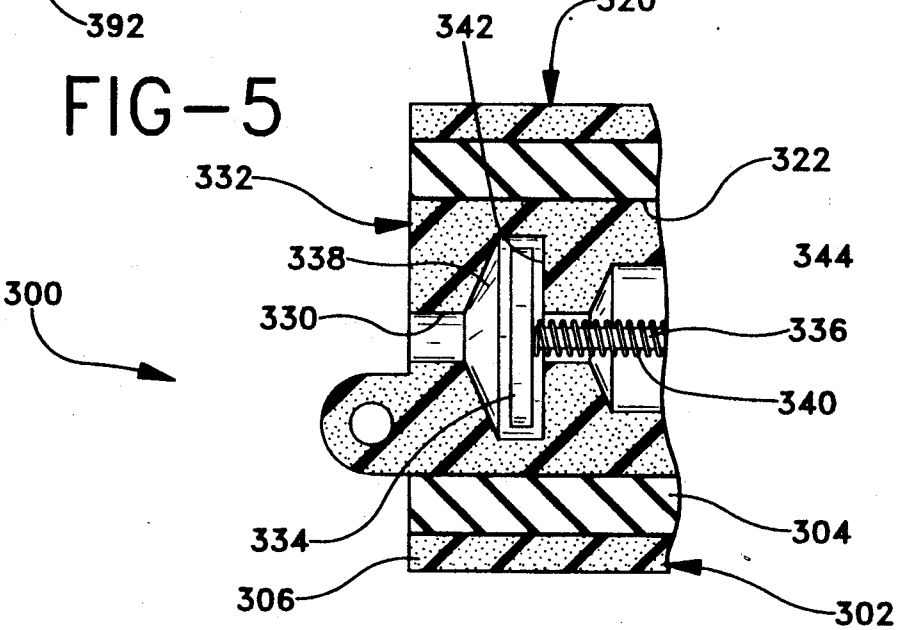
FIG. 5 is a fragmentary side elevational view, partially in section, of the end portion of the vertical leg of the device of FIG. 2 incorporating a check valve.

Metal cap 326 is provided with an ear 328 to which a ground conductor may be attached and a vent tube 330 to permit moisture, liquids or gases passing through vertical leg 320 to be expelled. Vent tube 330 is shown as a straight open tube but at times when the elbow 300 is located in a cable vault subject to flooding it is possible for undesired moisture or liquids to enter into vertical leg 320. To prevent this a check valve 332, as shown in FIG. 5 may be employed. A piston 334 is mounted upon a shaft 336 within a chamber 338. A tension spring 340 holds piston 334 against seat 342. In the presence of droplets 344 of sufficient weight on the back of piston 334, piston 334 is forced away from seat 342 to permit the moisture to enter chamber 338 and exit vent tube 330. When droplets 344 of sufficient weight are not present on the back surface of piston 334, spring 340 returns the piston to its position against seat 342. The spring 340 can be chosen so as to respond to any desired water level or water weight on the back of piston 334.

Figure 7:
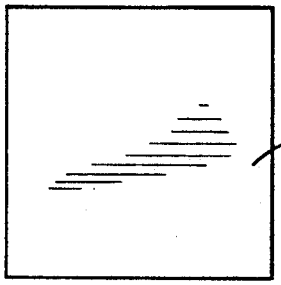
FIG. 7 is a side elevational view of a collection container for use with the device of FIG. 2.

Any fluid entering vent tube 330 will operate against the front of piston 334 forcing its back face against seat 342 sealing central bore 322. If desired not to permit the liquids or fluids which may contain contaminants to contact the soil and thus affect the environment, a collection container 350 as shown in FIG. 7 may be employed. Container 350 may be constructed of any desirable insulating material not affected by the possible contaminants to be found in the cable and system and may be attached to elbow 300 or placed below it.

Turning again to FIG. 2 it can be seen that the module 324 each have a passageway 360 therethrough. A portion of the passageway 360 is linear as at 362 and a portion is curved as at 364. The exact shape is not significant except that the total passageway is greater in length than the length of leg 320 and that the passageway have a shape that does not permit a continuous stream of liquid to flow through passageway 360 but rather breaks up such stream into discontinuous pools or droplets thus preventing the conductive liquid from conducting current between the system and any one coming in contact with the expelled liquid. Rather than continuous stream flow, the passageway 360 encourages a drop by drop passage between the modules 324 from top to bottom of FIG. 2.

Figure 6:
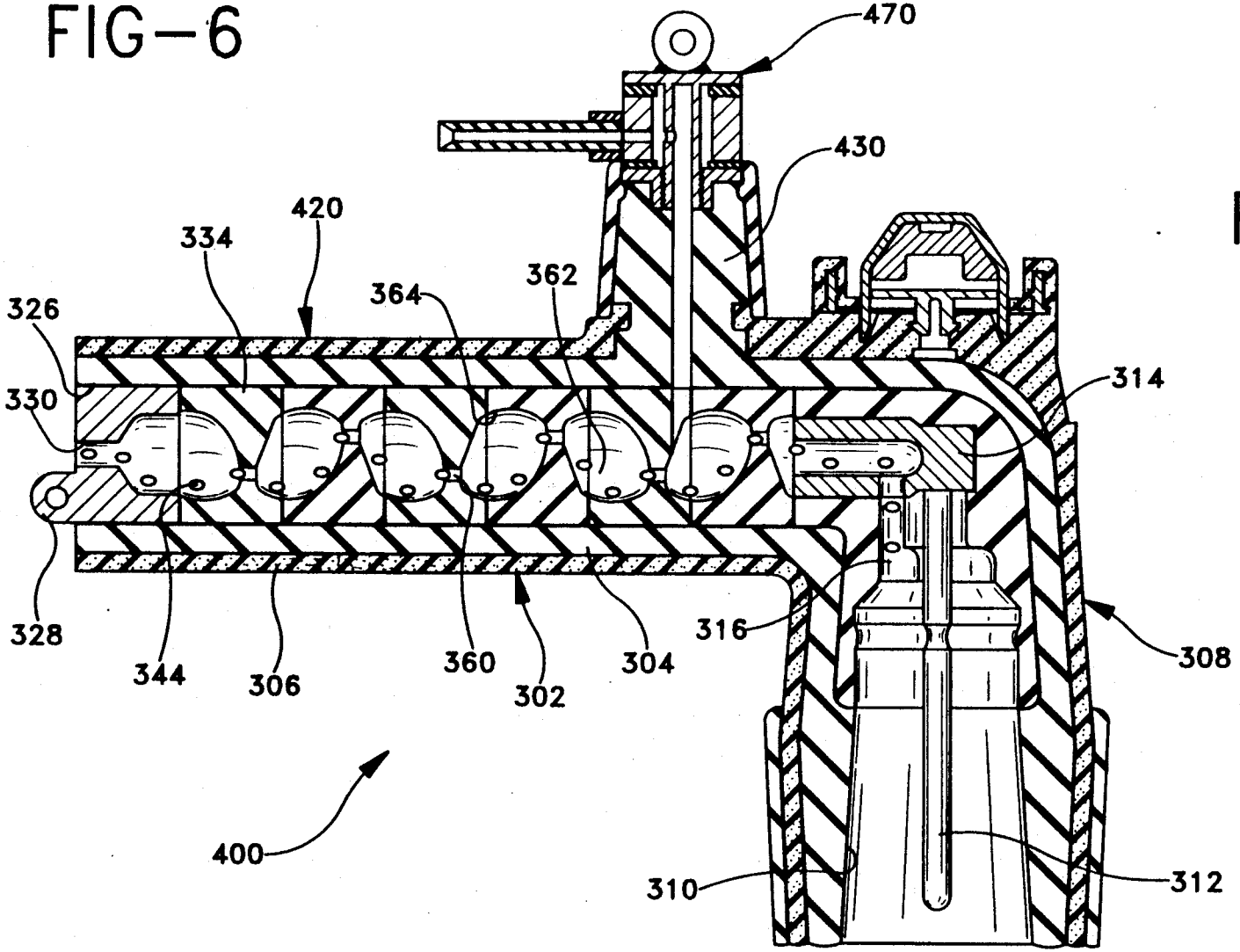
FIG. 6 is a side elevational view, in section, of the device of FIG. 2 modified to include an access according to FIG. 1.

If gravity is insufficient to permit the flow of the moisture, gases or liquids from the components of the system into elbow 300 it is possible to assist this movement by applying a vacuum to the elbow. This can be accomplished by using the elbow 400 of FIG. 6. Elbow 400 is similar in almost all aspects to elbow 300 except that vertical leg 420 has been modified to include a projection 430 similar to projection 230 of FIG. 1. A suitable fitting 470 can be attached to projection 430 and a vacuum applied to draw the moisture, liquids and gases from the system to which elbow 400 is connected. It should be understood that while elbow 400 is in use with a vacuum applied to projections 430 the overall system must be derated as to the maximum voltage which can be applied without flashover. Once the vacuum device (not shown) is removed and the cap (not shown) is reapplied as taught in the '393 patent the full voltage rating of the elbow 400 may again be used.

Figure 4:
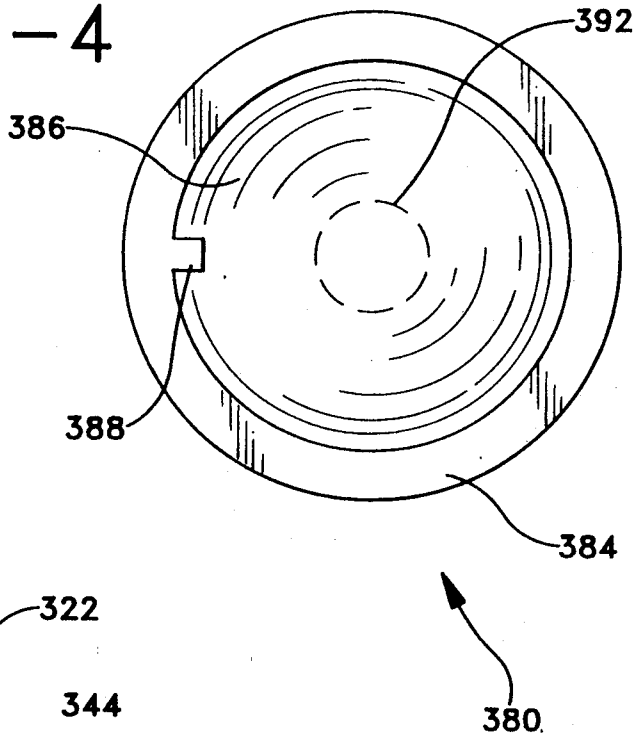
FIG. 4 is a top plan view of the module of FIG. 3.
Figure 3:
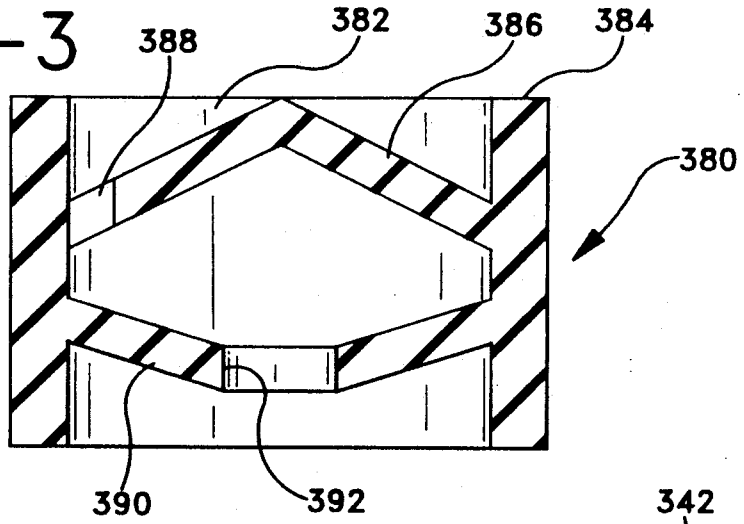
FIG. 3 is a side elevational view, in section, of a module which may be used with the device of FIG. 2 by substituting the modules of FIG. 3 for those shown in FIG. 2.

Alternatively, the modules 380 as shown in FIGS. 3 and 4 may be substituted for the modules 324 of FIG. 2. These modules 380 are also fabricated from a non-tracking insulating material such as EPDM rubber, silicone rubber, ceramic or similar materials and use a passageway 382 where all the component surfaces are linear making them simpler to mold. A circular wall 384 contains at a first level a conical barrier 386 tapering from an apex at the center to a base contacting the interior of wall 384. A single aperture 388 permits accumulated liquid to drop to the second barrier 390. The barrier 390 in the form of an inverted truncated cone has a central aperture 392 at the truncated apex which permits the liquid exiting to drop upon the barrier 386 of the next lower stacked module 380. A module could be easily constructed in which all defining surfaces of the passageway through the modules are curves only. Regardless of the shapes of the passageway defining walls, the two criteria must be met: 1) a long path greater in length than the height of the vertical leg and 2) a configuration which prevents the liquids from flowing through the modules in a continuous stream.

Figure 9:
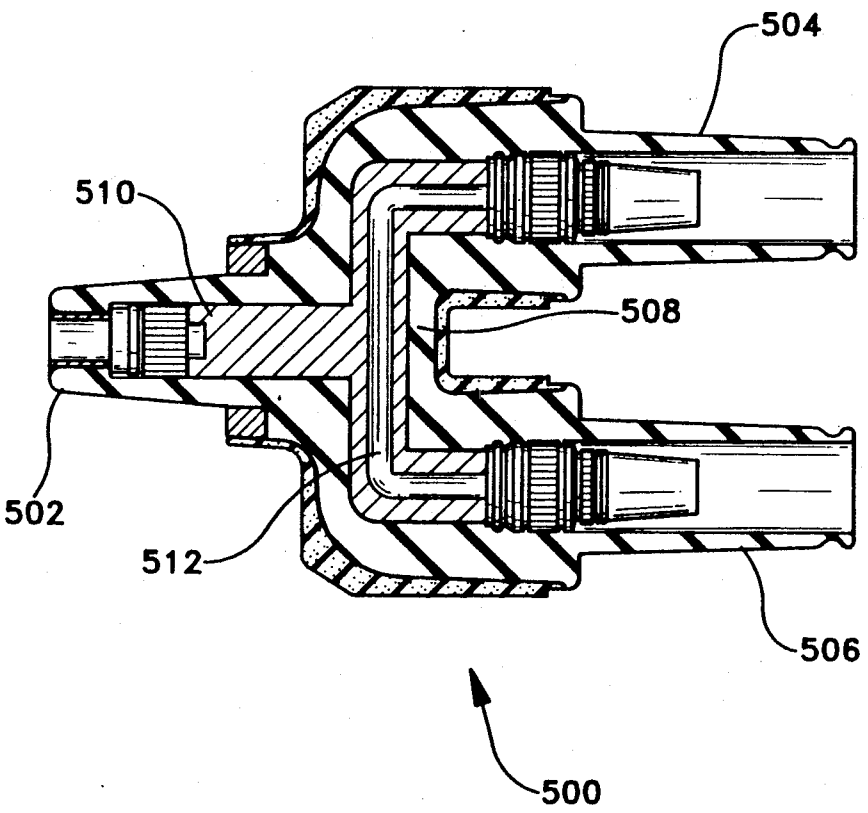
FIG. 9 is a top plan view, in section of a double bushing modified so that the device of FIG. 2 can be connected to one leg thereof to expel liquid from a system component while the system is active.

To use the elbows 300 and 400 on active systems without de-energizing the system, a modified double bushing insert 500 of the type shown in FIG. 9 may be employed. Bushing insert 500 has a leg 502 which may be inserted into an apparatus bushing well (not shown) and two load break legs 504 and 506 for receiving elbow connectors, one with a cable containing moisture or liquid to be removed and the other with an elbow device of the type shown by elbow devices 300 and 400 of FIGS. 2 and 6, respectively. Legs 504 and 506 are connected by a common bus bar 508 which is also connected to bus bar 510 to join electrically the legs 502, 504 and 506. A bore 512 in bus bar 508 joins legs 504 and 506 so that moisture or liquid in the cable (not shown) attached by a suitable elbow (not shown) to leg 504 can flow through bore 512 in bus bar 508 to leg 506 and thence into an elbow device such as 300 or 400 (not shown) coupled to leg 506.

Figure 8:
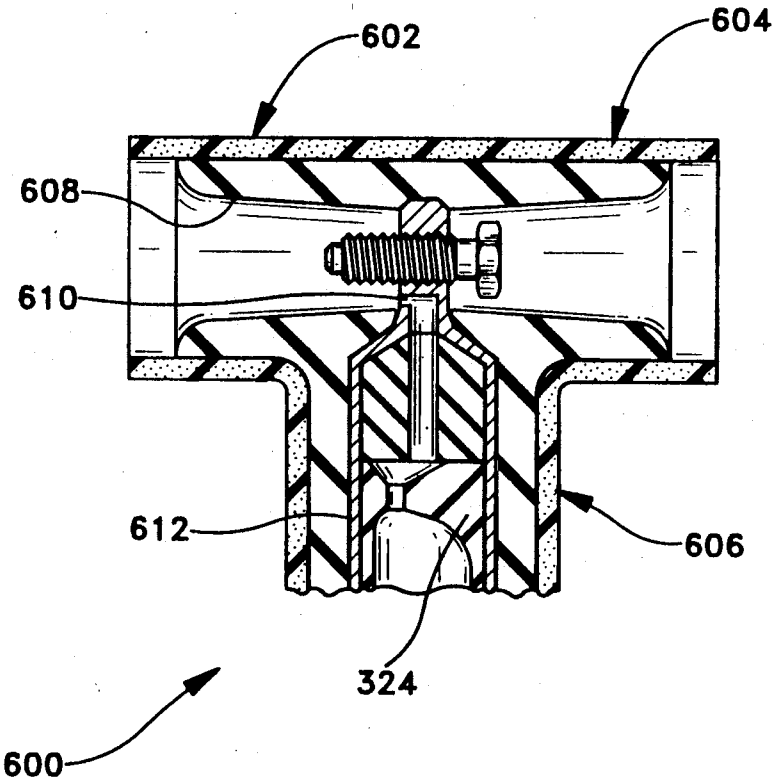
FIG. 8 is a fragmentary side elevational view, in section, of a T-shaped connector modified to include an exit path of the type shown in FIG. 2.

An in-line method of moisture removal is possible for an active network by using a T-shaped connector 600 as is shown in FIG. 8. One arm 602 is coupled to a bushing connected to a transformer or the like. The second arm 604 can receive a bushing insert for connection to an elbow as is well known in the art. The vertical leg 606 is not employed to receive the cable connector as is typical of this arrangement but instead is used to house a number of modules such as 324 (as shown) or 380. A passage 610 permits moisture, gases or liquid to exit from receptacle 608 into connector 612 and into the bore of vertical leg 606. The operation of the module 324 is as described above with respect to FIG. 2.

While there have been shown and described and pointed out the fundamental novel features of the invention as applied to the preferred embodiments, it will be understood that various omissions and substitutions and changes of the form and details of the devices illustrated and in its operation may be made by those skilled in the art without departing from the spirit of the invention.

The embodiments of the invention in which an exclusive property or privilege is claimed are defined as follows:

1. An electrical connector device for use with high voltage system components for the safe expulsion of conductive moisture within such components comprising: a body member having a horizontal leg having a bore therethrough from a first end to a second end; means adjacent said first end of said horizontal leg for coupling said device to a high voltage system component; a vertical leg having a first end and a second end, said first end of said vertical leg coupled to said second end of said horizontal leg; said vertical leg having a bore therethrough from a first end to a second end; means in said bore of said vertical leg to provide a passageway therethrough from said first end to said second end of said vertical leg, said passageway communicating with said bore of said horizontal leg adjacent said first end of said vertical leg and said second end of said horizontal leg; said passageway following a circuitous path within said vertical leg of a length substantially greater than the distance between said first end and said second end of said vertical leg measured along the outer surface of said vertical leg of said body member; and a drain adjacent said second end of said vertical leg to expel all conductive moisture entering said device.

2. An electrical connector device as set forth in claim 1, further including a collection container adjacent said vertical leg to collect the conductive moisture expelled from said device to prevent damage to the environment.

3. An electrical connector device as set forth in claim 1, further including an access port in said vertical leg to permit the application of a vacuum to said device to draw conductive moisture from said high voltage components to which said device is coupled.

4. An electrical connector device as set forth in claim 1, wherein said body member is comprised of an insulating material.

5. An electrical device as set forth in claim 1, wherein said body member is comprised of insulating EPDM elastomeric.

6. An electrical connector device as set forth in claim 1, wherein said body member is comprised of an insulating material and is covered by a layer of conductive material.

7. An electrical connector device as set forth in claim 1, wherein said body member is comprised of insulating EPDM elastomeric and said insulating EPDM elastomeric covered by a layer of conductive elastomeric material.

8. An electrical connector device as set forth in claim 1, wherein said means adjacent said first end of said horizontal leg comprises a receptacle and a probe to permit said device to be separately joined to a high voltage system component having a corresponding interface.

9. An electrical connector device as set forth in claim 1, wherein said means adjacent said first end of said horizontal leg comprises a first receptacle and fastening means to couple said device to a first high voltage system component having a corresponding interface and further includes a second receptacle to permit said device to be coupled to a second high voltage system component while permitting engagement of said first and second high voltage system components.

10. An electrical connector device as set forth in claim 1, wherein said means in said bore of said vertical leg is at least one module having a passageway therethrough longer than the height of such at least one module.

11. An electrical connector device as set forth in claim 10, wherein said passageway through said at least one module is curved to give a length greater than the height of said at least one module.

12. An electrical connector device as set forth in claim 10, wherein said passageway through said at lease one module is linear to give a length greater than the height of said at least one module.

13. An electrical connector device as set forth in claim 10, wherein said passageway through said at least one module has curved and linear portions to give a length greater than the height of said at least one module.

14. An electrical connector device as set forth in claim 1, wherein said means in said bore of said vertical leg comprises a plurality of modules stacked one atop the other to fill said bore of said vertical leg, each of said modules having a passageway therethrough and communicating with like passages in the adjacent modules; the total length of said combined passageways of said modules being greater than the height of the stacked modules with the bore of said vertical leg.

15. An electrical connector device as set forth in claim 14, wherein each of said passageways is curved.

16. An electrical connector device as set forth in claim 14, wherein each of said passageways is linear.

17. An electrical connector device as set forth in claim 14, wherein each of said passageways has a curved portion and a linear portion.

18. An electrical connector device as set forth in claim , wherein said drain is a metal end cap fitted into the bore of said vertical leg adjacent said second end thereof, said cap having an aperture therethrough to permit the expulsion of conductive moisture entering said device.

19. An electrical connector device as set forth in claim 18, wherein said drain further includes means for grounding said drain to dissipate any charge on the conductive moisture expelled from said device.

20. An electrical connector device as set forth in claim 18 wherein said drain further comprises a check valve to permit the expulsion of conductive moisture from within said device but prevents the introduction of moisture into said device through said drain.

* * * * *

UNITED STATES PATENT AND TRADEMARK OFFICE

CERTIFICATE OF CORRECTION

PATENT NO. : 5,215,475

DATED : JUNE 1, 1993

INVENTOR(S) : David R. Stevens

It is certified that error appears in the above-identified patent and that said Letters Patent is hereby corrected as shown below:

Col. 8, line 27,

"claim ," should read--claim 1,--.

Signed and Sealed this

Eighteenth Day of January, 1994

Bruce Lehman

*Attest:*

BRUCE LEHMAN

*Attesting Officer*

*Commissioner of Patents and Trademarks*